United States Patent [19]

Swenson

[11] Patent Number: 4,742,634

[45] Date of Patent: May 10, 1988

[54] AUTOMATIC SLIDE GUARD

[76] Inventor: Armand D. Swenson, P.O. Box 606, Fallbrock, Calif. 92028

[21] Appl. No.: 29,250

[22] Filed: Mar. 23, 1987

[51] Int. Cl.[4] ..... F41C 17/00; F41C 27/00

[52] U.S. Cl. ..... 42/70.01; 42/71.02

[58] Field of Search ..... 42/70.01, 7, 71.02, 42/72

[56] References Cited

U.S. PATENT DOCUMENTS

| | | | |
|---|---|---|---|
| 978,092 | 12/1910 | Wesson | 42/7 X |
| 1,812,905 | 7/1931 | Stuyvesant | 89/148 |
| 1,940,362 | 12/1933 | McClarin, Sr. | 42/71.02 |
| 1,962,775 | 6/1934 | Jones | 42/71.02 |
| 2,654,174 | 10/1953 | Hansen | 42/71.02 X |
| 3,159,080 | 12/1964 | Freed | 42/7 X |
| 3,492,748 | 2/1970 | Swenson | 42/70.01 |

OTHER PUBLICATIONS

Hopkins, C., "Centimeter: The Gun", *American Handgunner*, Jul./Aug. 1987, pp. 41–43, 74–77.

*Primary Examiner*—Ted L. Parr

*Attorney, Agent, or Firm*—Singer & Singer

[57] ABSTRACT

An improved safety mechanism for an automatic pistol of the type using a slide for moving and ejecting cartridges. A substantially flat slide guard is fixedly attached to the safety lock and is mounted in a spaced apart relationship with respect to the moveable slide. In this manner the fingers of the hand of the user are kept away from the slide when the gun is held in the firing position. A safety lock lever is attached to the slide guard thereby allowing the thumb of the user to operate the slide stop safety in the normal manner. For those pistols having a left and right safety lock lever a slide guard is located on each side of the gun thereby keeping the fingers of the user off the slide regardless of whether the user is using his right or left hand to operate the gun.

6 Claims, 2 Drawing Sheets

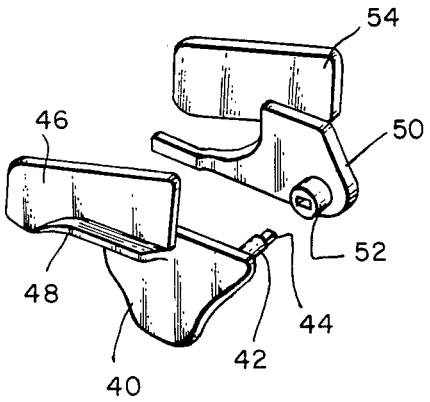
Fig. 5.
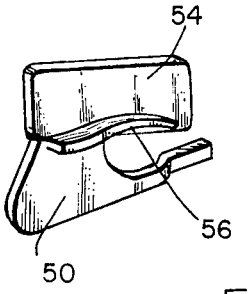
Fig. 6.
Fig. 7
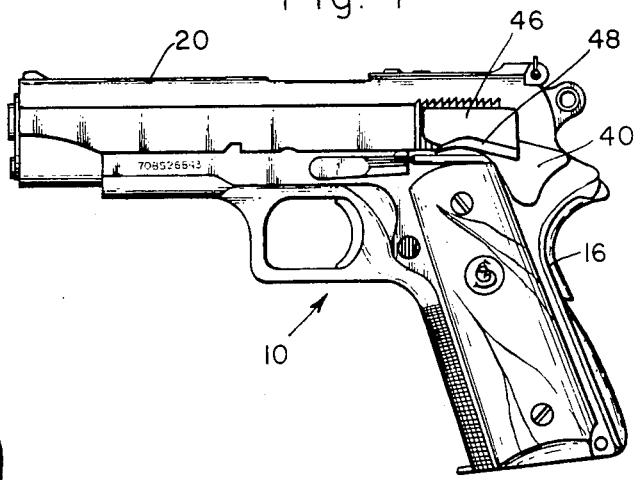
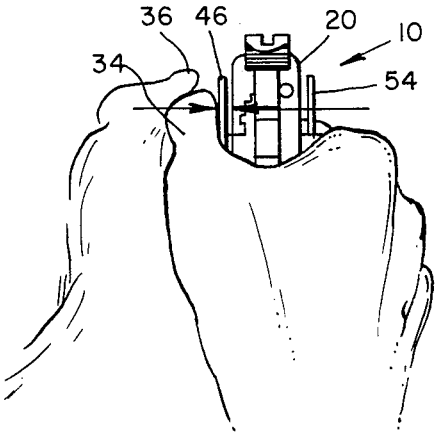
Fig. 8.
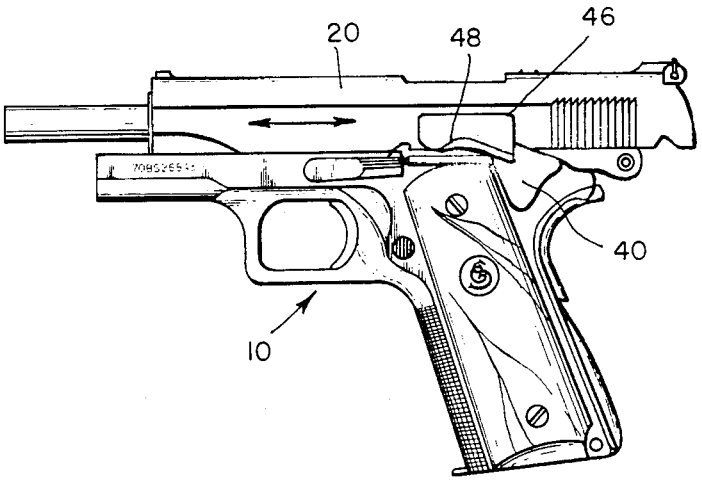
Fig. 9.

AUTOMATIC SLIDE GUARD

This invention relates to an improved safety and slide guard for a conventional pistol such as the 1911-A1 model automatic in different calibers (22, 9 mm, 38 Super, 38/45) and similar types of other pistols. These pistols are characterized by having a slide mechanism for feeding and ejecting a shell into and out of the gun barrel and having a thumb operated safety lock lever usually located on the left side of the handle. The invention is also adapted for use with pistols having a thumb operated safety lock lever on the right side of the handle and for use with pistols having left and right thumb operated safety lock levers such as taught in U.S. Pat. No. 3,492,748 entitled Pistol Safety Mechanism Adapted For Right or Left Hand Operation and invented by the same inventor as the present invention.

The present invention is concerned primarily with assisting the shooter in developing good shooting techniques and reliable operation from his pistol regardless of whether he uses the single hand shooting stance or the double hand shooting stance.

In the shooting fraternity and specifically for those shooters engaged in shooting contests there is a wide dichotomy among shooters as to whether the single hand stance or the two handed stance is preferable. In the area of combat shooting it is generally agreed that the two hand stance is preferable and for a variety of reasons that are beyond the scope of this Patent.

It is essential however that the shooter have a pistol that is reliable and that he or she develope a stance that allows the gun to get on target quickly and with a minimum of effort.

In combat shooting it is most desirable for the shooter to quickly draw the gun and get on target quickly while the gun is being drawn and aimed. The tension of drawing a gun quickly, getting on target, holding the gun and shooting has caused many a shooter to grip and hold the pistol in such a way that movement of the slide is impeded and restricted.

In the use of the semi-automatic 1911 pistol it is necessary for the user to push the slide back fully in order to cock the trigger and allow the slide to pull the cartridge into the firing position. Then the shooter pulls the trigger and the hammer falls causing the exploding gases to expel the bullet and at the same time build up a pressure which causes the slide to retract thereby allowing the shell to be ejected and allow the moving slide to pick up the second cartridge for insertion into the barrel.

It has been discovered that many shooters, in their haste to draw and aim, allow a portion of their hand and usually their thumb to contact the slide. Touching the slide restricts the movement of the slide which has the effect of preventing a full discharge of the expended shell thereby resulting in a jam and possible misfire. In this position the gun is unusable as a weapon and the shooter must clear the caartridge and the slide which procedure takes time and exposes the shooter to uncalled for dangers when in a combat situation.

In the present invention the shooter fingers are prevented from contacting the slide when holding the gun in the shooting position by means of a substantially flat guard that is fixedly attached to the safety lock that is usually located on the left side of the pistol.

The slide guard is mounted on the safety lock in a spaced apart relationship with respect to the moveable slide and in this way prevents any contact between the operators fingers and the moveable slide. The safety lock is operated in the usual fashion by means of a safety lock lever adapted to be thumb operated and which is fixedly attached to the slide guard.

In a second embodiment there is described the use of a safety on the left and right side of the pistol as taught by U.S. Pat. No. 3,492,748 and how a slide guard is mounted both on the left safety lock lever and the right safety lock lever thereby allowing a single pistol to have a slide guard available for either left handed shooters or right handed shooters.

Further objects and advantages of this invention will be made more apparent as the description progress, reference now being made to the accompanying drawings wherein:

FIG. 5 is an exploded view illustrating the cooperation between the left hand safety lock with slide guard and the right hand slide guard with a thumb actuating safety lock lever constructed according to the teachings of the present invention;

FIG. 6 illustrates the right hand slide guard and thumb operated safety lock lever;

FIG. 7 is a left side elevation of a conventional type automatic pistol having a slide guard constructed according to the teachings of the present invention;

FIG. 8 is a rear view illustration of a gun illustrated in FIG. 8 being held by two hands in the firing position; and FIG. 9 illustrates a left side elevation of a conventional type automatic pistol having a slide guard constructed according to the present invention with the slide retracted to its rearmost position.

The slide guard which is the subject matter of the present invention may be used with a pistol having a single safety located on the left side or a single safety located on the right side or it may be used with a pistol having safety lock levers on both sides as is described in the Armond D. Swenson U.S. Pat. No. 3,492,748.

Figure 1:
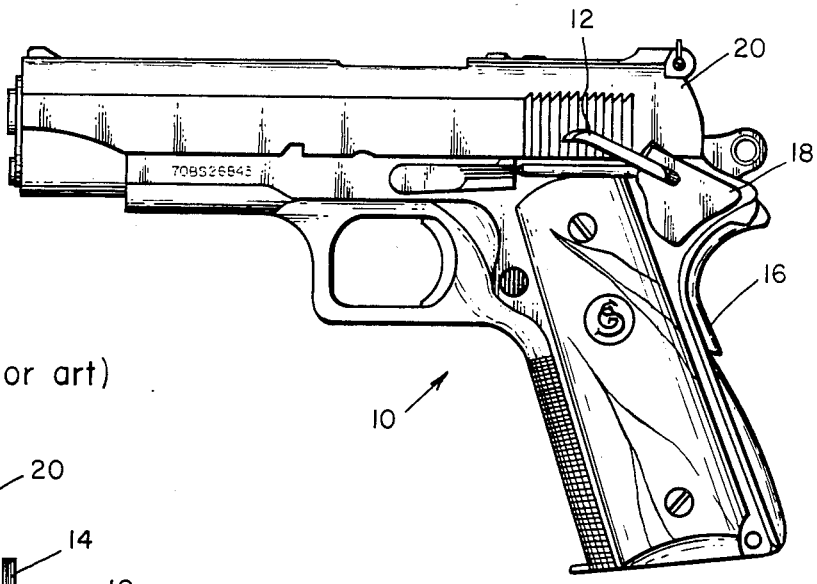
Fig. 1. (prior art)
FIG. 1 is a left side elevation of a conventional type automatic pistol having a safety mechanism that is adapted for use by the thumb of either the right hand or the left hand.
Figure 2:
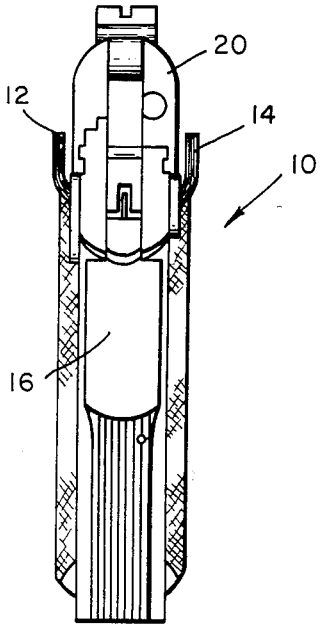
Fig. 2. (prior art)
FIG. 2 is rear view of the gun illustrated in FIG. 1 illustrating the relative position between the safety lock located on the left side of the gun and the thumb operated safetylock lever located on the right side of the gun.

FIGS. 1 and 2 illustrate a conventional pistol 10 having a thumb operated safety lock lever 12 located on the left side and a thumb operated safety lock lever 14 located on the right side of the gun.

Pistols of this type normally incorporates safety features such as a grip safety 16 and a safety lock 18 located on the left side of the pistol 10 for holding a slide 20 in a first non-moveable position. Pushing the safety lock lever 12 in a downward direction rotates the safety lock 18 into a second position that allows the slide 20 to move freely in a fore and aft position.

The concept of having a left and right hand operated safety lock lever 12 and 14 is fully described and illustrated in connection with reference Swenson U.S. Pat. No. 3,492,748.

Figure 3:
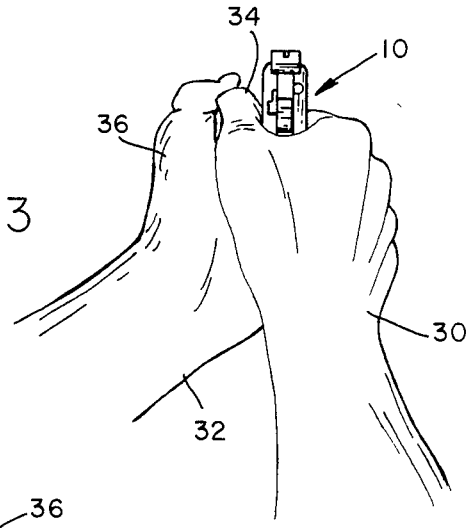
FIG. 3 is a rear view illustration showing a gun being held by two hands in the firing position.
Figure 4:
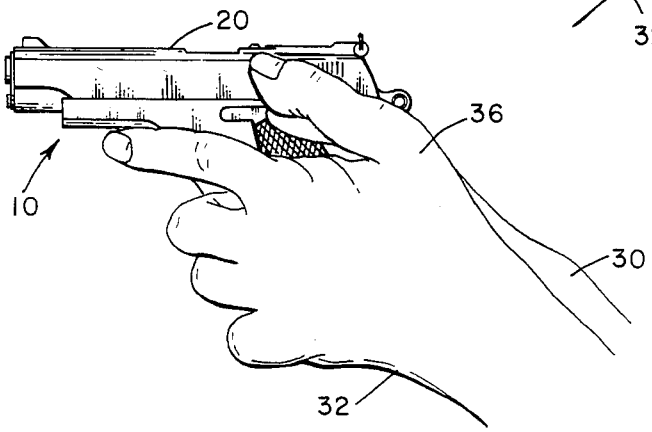
FIG. 4 is left side view illustration showing a gun being held by two hands in the firing position.

Referring now to FIGS. 3 and 4 there is shown a two handed grip commonly used by shooters and which shows the right hand of the user 30 gripping the gun 10 while the left hand 32 overlays the fingers of the right hand and provides additional support. The thumb 34 of the right hand is shown encircling the gun 10 while the thumb 36 of the left hand is shown overlaying the thumb 34 of the right hand to provide additional support.

Referring now to FIG. 4 there is illustrated the problem that sometimes occurs when the thumb 36 of the left hand not only holds the thumb 34 of the right hand in position but also is extended over and contacts the slide 20. This action prevents s free lateral movement of the slide after the gun has fired. Impeding the movement of slide 20 creates a malfunction by limiting the movement of the slide which prevents the ejection of the empty shell and at the same time prevents the new cartridge from being inserted into the barrel. Any restriction on the slide 20 will result in a malfunction that must then be cleared before the gun can again be fired. Obviously in a combat situation any malfunction becomes a matter of life and death for the shooter of the gun and must be avoided at all costs.

It is quite obvious that instruction in properly holding the gun is most important to prevent the thumb of either hand from touching the slide. Unfortunately human beings being what they are in a tense environment such as in a combat situation will grab the pistol in a way that may impede the movement of the slide and cause a jam.

It is the purpose of the present invention to prevent a malfunction of the gun by preventing either the right hand or the left hand of the shooter from contacting the slide after the trigger has been pulled.

While the problem of contacting the slide with the thumb of the left hand has been illustrated in connection with FIGS. 3 and 4 it is quite obvious that the same probable exists for left handed shooters.

Referring now to FIG. 5 there is shown slide guard adapted for use on both the left and right side of a semi-automatic pistol.

The left side of the gun contains a safety lock 40 fixedly attached to a shaft 42 having a male projection 44 and in which the shaft is adapted to extend longitudinally through the handle of the gun. This is typical construction and is conventional with all pistols of this type.

A substantially flat slide guard 46 is fixedly attached to the safety lock 40 and is mounted in a spaced apart relationship with respect to the moveable slide 20 of the pistol 10 such as that illustrated in FIGS. 7 and 8 thereby allowing the slide 20 to move in a fore and aft position and without contacting the guard 46. Located on the outermost portion of the slide guard 46 is a thumb operated safety lock lever 48 which is adapted to be operated by the thumb of the rights hand of the shooter. For those guns having a thumb operated safety lock lever on the right side there is illustrated a bracket 50 having a female mating portion 52 adapted to mate with the male portion 44 attached to shaft 42. Located on the far side of slide 50 is a substantially flat slide guard 54 similar to that illustrated and identified as guard 46 and mounted in a spaced apart relationship with respect to the moveable slide 20 as illustrated in connection with FIG. 8 thereby preventing the thumb on the left hand of the left handed shooter from interfering with the for and aft movement of the slide 20.

Referring now to FIG. 6 there is shown another view of bracket 50 and guard 54 which more fully illustrated the thumb operated safety lock lever 56 which is fixedly attached to the guard 54 and which allows the thumb of the left handed operator to impart a motion through the bracket 50 to rotate shaft 42 and thereby operate the safety lock 40 on the left side of the gun. It will be apparent that the safety feature of the gun is not modified since the safety feature to prevent the slide from moving is still the operation of the safety lock 40 and it is only the operation of the thumb of the right hand contacting the thumb safety lock lever 48 or the thumb of the left handed contacting the safety lock lever 56 that eventually operates the safety lock 40.

Referring now to FIG. 7 there is shown a left side elevational view of the gun 10 more fully illustrating the safety lock 40 with the guard 46 attached and the thumb operated safety lock lever 48 attached to the guard 46. The right side which is not illustrated would be identical to that illustrated in connection with FIG. 7.

Referring now to FIG. 8 there is shown the gun 10 having the guards 46 and 54 constructed in accordance with the present invention and in which the gun is supported by the user in a two hand grasp. FIG. 8 illustrates how the thumb 34 of the right hand or thumb 36 of the left hand is prevented from contacting the slide 20 by means of the guard 46. The same would be true for a left handed user since the guard 54 would prevent any contact of the users hand with the operating slide.

Referring now to FIG. 9 there is shown a left hand elevation view showing the lateral movement of the slide 20 after the bullet has been ejected and shows the free moving slide moving for and aft in its normal operating position.

This completes the description of the invention however it will be appreciated by those skilled in the art that the pistol 10 may have only a single thumb operated safety lock lever which may be located either on the left or right side of the gun and that the invention is illustrated with one having both a left handed operated safety lock lever and a right handed operated safety lock lever for convenience in order to show the widest use and scope of the invention.

I claim:

1. An improved safety mechanisms for an automatic pistol having a slide ejecting mechanism comprising;

a moveable safety lock having a first position adapted to prevent movement of a moveable slide associated with an automatic pistol and a second position adapted to allow movement of the slide;

said safety lock mounted for pivotal motion about a shaft adapted to be supported by a handle portion associated with said automatic pistol;

said shaft integrally connected with said safety lock and extending transversely through said handle portion;

a substantially flat slide guard fixedly attached to said safety lock and mounted in a spaced apart relationship substantially opposed to one side of the moveable slide thereby preventing contact between operator's hand and the moveable slide; and a safety lock lever adapted to be thumb operated and fixedly attached to said slide guard.

2. An improved safety according to claim 1 in which said slide guard is attached on one side to said safety lock and on the other side to said safety lock lever.

3. An improved safety according to claim 1 in which said slide guard is substantially rectangular with the long side extending along the side of the slide.

4. An improved safety according to claim 3 in which said safety lock lever extends longitudinally along said slide.

5. An improved safety according to claim 4 in which the length of said slide guard is longer than the length of said safety lock lever.

6. An improved safety mechanism for an automatic pistol having a handle portion defining a first side and a second side comprising;

a moveable safety lock having a first operating position and a second operating position located on the first side of a handle portion associated with an automatic pistol;

said safety lock mounted for pivotal motion about a shaft for rotating said safety lock from said first operating position to said second operating position and adapted to be supported by a handle portion whereby said shaft is exposed on the opposite or second side of said handle portion;

the exposed end of said shaft comprising a first mating portion;

a bracket adapted to be located on the second side of said handle portion and having a second mating portion for connecting said shaft and said bracket together whereby rotational movement of said safety lock rotates said bracket;

a first and second substantially flat slide guards with said first guard fixedly attached to said safety lock on one side of said handle and said second guard fixedly attached to said bracket on the other side of said handle;

each of said flat slide guards mounted in a spaced apart relationship adjacent a moveable slide associated with an automatic pistol thereby preventing contact between the operators hand and the moveable slide; and a first and second safety lock lever each adapted to be thumb operated and with said first safety lock lever fixedly attached to said safety lock and said second safety lock lever fixedly attached to said bracket.

* * * * *